US010458168B2

(12) United States Patent
Hammerer

(10) Patent No.: US 10,458,168 B2
(45) Date of Patent: Oct. 29, 2019

(54) FURNITURE HINGE

(71) Applicant: Julius Blum GmbH, Hoechst (AT)

(72) Inventor: Andre Hammerer, Alberschwende (AT)

(73) Assignee: JULIUS BLUM GMBH, Hoechst (AT)

( * ) Notice: Subject to any disclaimer, the term of this patent is extended or adjusted under 35 U.S.C. 154(b) by 40 days.

(21) Appl. No.: 15/817,951

(22) Filed: Nov. 20, 2017

(65) Prior Publication Data

US 2018/0087307 A1 Mar. 29, 2018

Related U.S. Application Data

(63) Continuation of application No. PCT/AT2016/050145, filed on May 17, 2016.

(30) Foreign Application Priority Data

Jun. 18, 2015 (AT) ..... A 389/2015

(51) Int. Cl.
*E05F 1/08* (2006.01)
*E05F 3/20* (2006.01)
(Continued)

(52) U.S. Cl.
CPC ..... *E05F 3/20* (2013.01); *E05D 3/06* (2013.01); *E05D 3/16* (2013.01); *E05D 11/1021* (2013.01);
(Continued)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 4,368,558 A 1/1983 Grass
4,400,848 A 8/1983 Grass
(Continued)

FOREIGN PATENT DOCUMENTS

CN 101356335 1/2009
CN 201474473 5/2010
(Continued)

OTHER PUBLICATIONS

International Search Report dated Aug. 29, 2016 in International (PCT) Application No. PCT/AT2016/050145.
(Continued)

*Primary Examiner* — Chuck Y Mah
(74) *Attorney, Agent, or Firm* — Wenderoth, Lind & Ponack, L.L.P.

(57) ABSTRACT

A furniture hinge includes a first hinge portion to be fixed to a furniture carcass, a second hinge portion having a hinge cup to be fixed to a movably-mounted furniture part, a hinge axis connecting the first hinge portion and the second hinge portion, a bearing portion inserted into the hinge cup, the bearing portion including a cavity, and a spring device configured to move the furniture hinge from a predetermined angular position into a fully closed position and/or into a fully open position. A first end region of the spring device is supported on the bearing portion when the bearing portion is inserted into the hinge cup, the cavity being configured to accommodate the spring device. A convex control curve configured to interact from the predetermined angular position towards the fully closed position with the spring device. A pressure portion has a counter contour configured to be pressed against the convex control curve by the spring device. The counter contour has a concave section complementary to the convex control curve.

19 Claims, 6 Drawing Sheets

(51) Int. Cl.

| | |
|---|---|
| ***E05D 3/06*** | (2006.01) |
| ***E05D 3/16*** | (2006.01) |
| ***E05D 11/10*** | (2006.01) |
| ***E05F 1/12*** | (2006.01) |
| ***E05F 5/00*** | (2017.01) |
| *E05D 5/08* | (2006.01) |

(52) U.S. Cl.
CPC ..... *E05D 11/1064* (2013.01); *E05F 1/1246* (2013.01); *E05F 1/1253* (2013.01); *E05F 5/006* (2013.01); *E05D 5/08* (2013.01); *E05D 2003/166* (2013.01); *E05Y 2201/22* (2013.01); *E05Y 2201/412* (2013.01); *E05Y 2201/424* (2013.01); *E05Y 2201/638* (2013.01); *E05Y 2900/20* (2013.01)

(58) Field of Classification Search
CPC ..... E05Y 2201/21; E05F 5/006; E05F 5/02; E05F 5/027; E05D 11/1021; E05D 11/1042; E05D 11/105; E05D 11/1064; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS

| | | | | |
|---|---|---|---|---|
| 4,434,523 | A | 3/1984 | Grass | |
| 4,493,129 | A | 1/1985 | Grass | |
| 5,500,983 | A | 3/1996 | Lautenschläger | |
| 5,655,261 | A | 8/1997 | Cress | |
| 8,424,161 | B2 * | 4/2013 | Sutterlutti | E05F 5/006 16/286 |
| 8,561,262 | B1 * | 10/2013 | Liang et al. | E05D 3/16 16/52 |
| 9,163,447 | B1 * | 10/2015 | Liang | E05F 5/006 |
| 2003/0200625 | A1 * | 10/2003 | Zimmer | E05F 5/006 16/306 |
| 2005/0015927 | A1 * | 1/2005 | Kropf | E05D 3/142 16/286 |
| 2007/0251058 | A1 * | 11/2007 | Fitz | E05D 3/16 16/287 |
| 2009/0049645 | A1 | 2/2009 | Salice | |
| 2011/0072617 | A1 * | 3/2011 | Lin | E05F 5/006 16/298 |
| 2011/0225768 | A1 | 9/2011 | Haemmerle | |
| 2011/0291538 | A1 * | 12/2011 | Brunnmayr | E05F 5/006 312/326 |
| 2011/0298349 | A1 * | 12/2011 | Sutterlutti | E05F 5/006 312/326 |
| 2012/0060325 | A1 | 3/2012 | Lin | |
| 2012/0174338 | A1 * | 7/2012 | Wu | E05F 5/006 16/297 |
| 2013/0019713 | A1 * | 1/2013 | Krudener | E05D 3/16 74/99 R |
| 2013/0145580 | A1 * | 6/2013 | Brunnmayr | E05F 5/006 16/277 |
| 2013/0160242 | A1 * | 6/2013 | Brunnmayr | E05F 5/006 16/286 |
| 2014/0352111 | A1 * | 12/2014 | Ng | E05F 5/02 16/286 |
| 2014/0366322 | A1 * | 12/2014 | Salice | E05F 5/006 16/277 |
| 2015/0330128 | A1 * | 11/2015 | Ng | E05D 3/16 16/65 |
| 2016/0138319 | A1 * | 5/2016 | Wu | E05D 3/02 16/50 |
| 2016/0153224 | A1 * | 6/2016 | Salice | E05D 3/16 16/52 |

FOREIGN PATENT DOCUMENTS

| | | |
|---|---|---|
| DE | 30 40 287 | 6/1982 |
| EP | 0 623 725 | 11/1994 |
| JP | 2010-501756 | 1/2010 |
| JP | 2012-512344 | 5/2012 |
| JP | 2013-091925 | 5/2013 |

OTHER PUBLICATIONS

Search Report dated Mar. 21, 2016 in Austrian Application No. A 389/2015, with English translation.

* cited by examiner

FURNITURE HINGE

BACKGROUND OF THE INVENTION

The invention relates to a furniture hinge having a first hinge portion to be fixed to a furniture carcass, a second hinge portion having a hinge cup to be fixed to a movably-mounted furniture part, and at least one hinge axis by which the first hinge portion and the second hinge portion are connected to one another. The furniture hinge further includes a spring device for moving the furniture hinge from a predetermined angular position into a fully closed position and/or into a fully open position. A first end region of the spring device is supported on a bearing portion inserted into the hinge cup. A convex control curve interacts from the predetermined angular position towards the fully closed position and/or fully open position with the spring device. The furniture hinge further includes a pressure portion having a counter contour which can be pressed against the control curve by the spring device. The counter contour has a concave section at least over a region. The concave section is formed complementary to the convex control curve.

DE 30 40 287 A1 discloses a furniture hinge having a hinge cup in which a helical spring and a pressure portion being acted upon by the helical spring are arranged. The spring-loaded pressure portion interacts with a convex control curve of a control element so that the hinge cup, together with the furniture part connected therewith, can be pressed into the fully closed position and/or into the fully open position. The pressure portion, for bearing against the control curve, has a wedge-shaped tip which is considerably loaded by the force of the spring device. Due to the small contact surface between the pressure portion and the control curve, there are point contacts with high surface pressure which result in premature wearing of these components and which restrict the force of the spring device. Moreover, the movement behavior of the furniture hinge, in particular upon a change in direction of the movable furniture part, is not satisfactory. In addition, the hinge cup needs to be equipped with a longitudinal bore so that the pressure portion and the spring device can be arranged within the hinge cup. Accordingly, the hinge cup is therefore a special design so that the manufacture in large numbers is relatively uneconomic.

U.S. Pat. No. 5,655,261 discloses a furniture hinge with a hinge cup which is hingedly connected via a hinged axis to a door-sided fitting portion. Arranged on the door-sided fitting portion is a pressure portion being pre-stressed by a helical spring, wherein the pressure portion presses against a control curve arranged on the hinged axis. The concave counter contour of the pressure portion thereby interacts with a convex section of the control curve in order for a high torque to be transmitted. Because of the arrangement of the pressure portion on the door-sided fitting portion, a relatively large installation space is required.

SUMMARY OF THE INVENTION

It is an object of the present invention to provide a furniture hinge of the abovementioned type, thereby avoiding the above-discussed drawbacks.

According to the invention, the bearing portion has a cavity for accommodating the spring device.

In this way, a very compact and visually unobtrusive arrangement of the spring device within the hinge cup can be obtained, thereby utilizing standard types of hinge cups.

The control curve and the counter contour of the pressure portion, at least over a region, have complementary contours or countercurrent forms, respectively, in relation to one another, so that the control curve and the counter contour lie flat on each other over a region. In this way, the occurring forces are distributed over a larger area, preventing point contacts or line contacts with high pressing forces.

The control curve and the counter contour of the pressure portion, at least in an intermediate position of the furniture hinge which corresponds approximately the half-open position of the movably-mounted furniture part in the mounted condition, bear against each other. In particular, the convex control curve and the concave contour of pressure portion which is formed complementary thereto, can be configured to lie flat on each other in a middle pivoting range of the furniture hinge between the two predetermined angular positions (i.e. in a pivoting range located between the respective self-pulling angles of the furniture hinge).

In this way, the control curve and the pressure portion do not need to each be formed of a highly wear-resistant metal. Instead, these components can be made of plastic. As a result, it becomes possible to more economically manufacture the furniture hinge.

BRIEF DESCRIPTION OF THE DRAWINGS

Further details and advantages of the present invention will be explained by way of the following description of figures, in which.

DETAILED DESCRIPTION OF THE INVENTION

Figure 1:
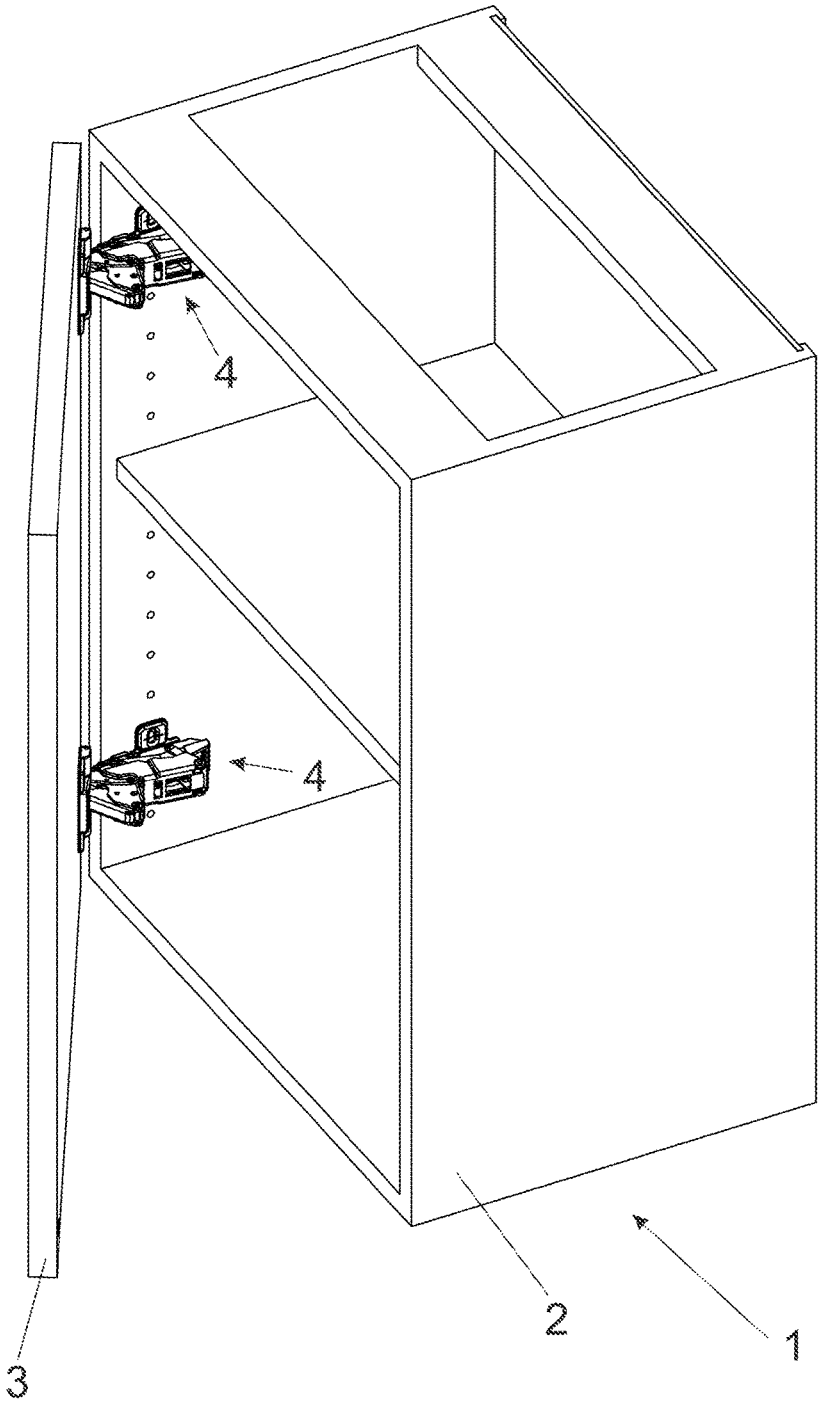
FIG. 1 shows an item of furniture having a movable furniture part which is pivotally supported relative to a furniture carcass.

FIG. 1 shows an item of furniture 1 having a movable furniture part 3 which is pivotally supported relative to a furniture carcass 2 by furniture hinges 4. The furniture hinges 4 are thereby formed as wide-angle hinges with at least five, preferably at least seven, hinge axes, so that the movable furniture part 3 can assume a maximum opening angle of at least 150°, preferably at least 170°, relative to the front face of the furniture carcass 2.

Figure 2:
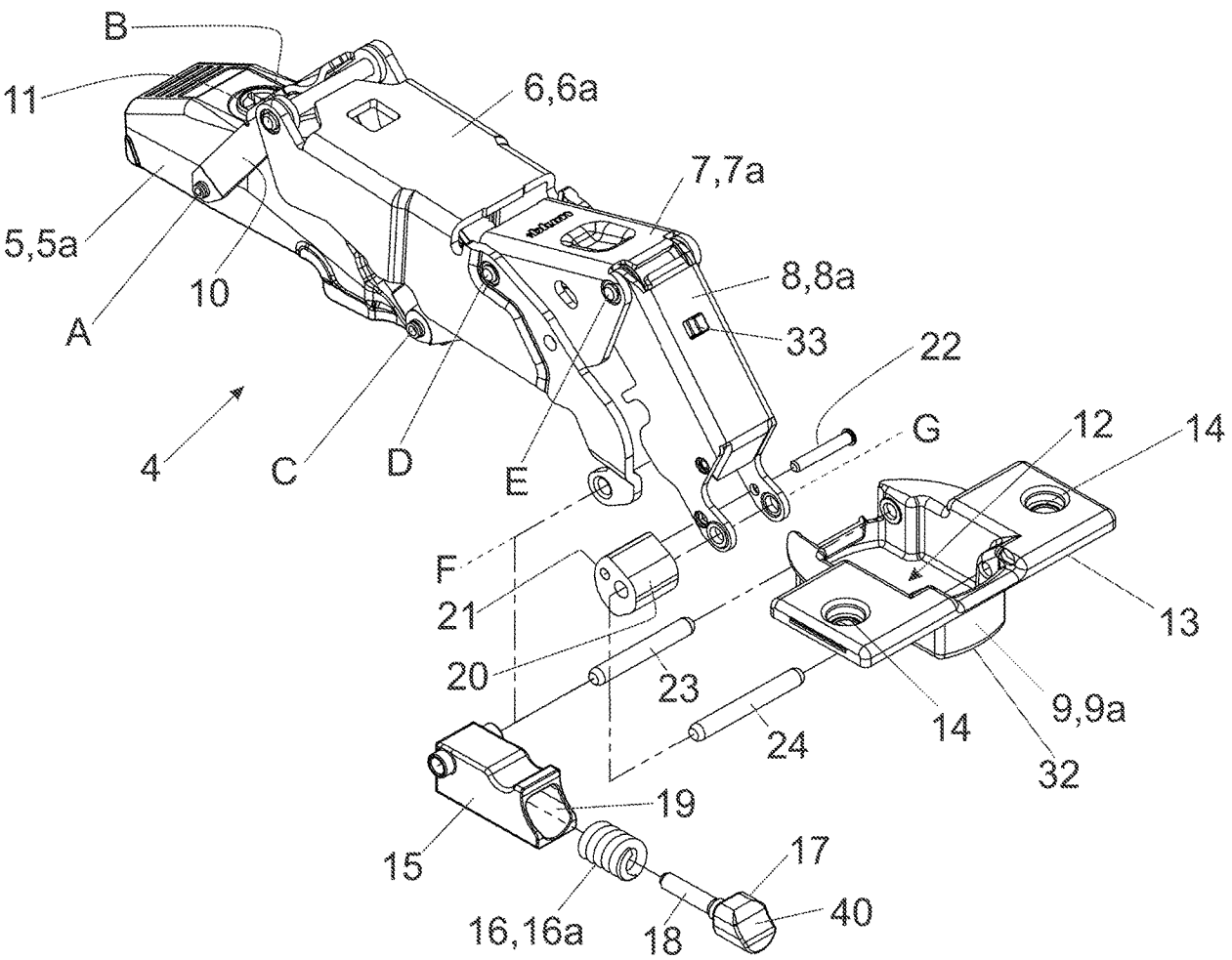
FIG. 2 shows a furniture hinge in an exploded view.

FIG. 2 shows an embodiment of a furniture hinge 4 formed as a wide-angle hinge in an exploded view. The furniture hinge 4 has a plurality of hinge portions 5, 6, 7, 8, 9, 10 which, as shown in the figure, are hingedly connected to one another by seven hinge axes A, B, C, D, E, F, G. These hinge portions 5, 6, 7, 8, 9, 10 can each have a U-shaped portion in cross-section. The hinge portion 5 is configured as a hinge arm 5*a* which can be snapped onto a base plate (not shown here) to be fixed to the furniture carcass 2 and which is adjustably arranged in a longitudinal direction of the base plate (thus in a depth direction of the furniture carcass 2) by way of an adjusting wheel 11. A further hinge portion 6 is configured as an intermediate piece 6*a* which is connected via at least one hinge portion 10 in the form of a pivotally mounted lever to the hinge arm 5*a*. The intermediate piece 6*a* is motionally coupled to a movement of the hinge 4, so that the movable furniture part 3, by way of a combined pivoting and displacement motion, is not only being pivoted relative to the furniture carcass 2 but also increases the distance relative to the furniture carcass 2 upon an opening movement. Connected to the intermediate piece 6*a* via the hinged axis D is a further hinge portion 7 in the form of a first hinged lever 7*a*. The other end of the first hinged lever 7*a* is connected via the hinged axis E to a further hinge portion 8 in the form of a second hinged lever 8*a*. The second hinged lever 8*a* is pivotally connected via the hinge axis G to a hinge portion 9 in the form of a hinge cup 9*a*. Arranged on the hinge axis G is a pin 24 with a control cam 20 arranged thereon. A convex control curve 21 is formed on the control cam 20. The convex control curve 21 forms a differing radial spacing relative to the hinge axis G. For the torque-proof arrangement of the control cam 20 on the hinged lever 8*a*, a bolt 22 is provided so that the control cam 20 can be arranged in a torque-proof manner on the hinged lever 8*a*. The hinge cup 9*a* has a flange 13 with openings 14 which are provided for the passage of screws to be screwed into the movable furniture part 3. Arranged on the hinge axis F is a further pin 23 to which a bearing portion 15 inserted into an internal cavity 12 of the hinge cup 9*a* is fixed. The bearing portion 15 has a cavity 19 for accommodating a spring device 16, preferably of a helical spring 16*a* in the form of a compression spring. The helical spring 16*a* surrounds a shaft 18 of a pressure portion 17 which can be pressed against the control curve 21 by the force of the helical spring 16*a*. In the mounted position, the bearing portion 15 is thus entirely accommodated within the internal cavity 12 of the hinge cup 9*a*, and the helical spring 16*a* is arranged within the hinge cup 9*a* in a lying position and is arranged substantially parallel to a base 32 of the hinge cup 9*a*. The hinge cup 9*a*, together with the helical spring 16*a* arranged therein, can be arranged entirely within a single cylindrical bore of the movable furniture part 3. As a result, a very compact and visually unobtrusive arrangement can be obtained while using standard types of hinge cups 9*a*.

According to an embodiment, the operating direction of the helical spring 16*a*, in the mounted position of the furniture hinge 4, extends substantially at a right angle relative to a longitudinal direction of the bore of the movable furniture part 3 into which the hinge cup 9*a* can be countersunk. The arrangement of the helical spring 16*a* within the internal cavity 12 of the hinge cup 9*a* has moreover the advantage that other available spaces within the U-shaped hinge portions 5, 6, 7, 9, 10 in cross section can be utilized for the arrangement of additional functional units, such as a damping device 25 for dampening a movement of the hinge 4 and/or an electrical drive for driving the furniture hinge 4.

FIGS. 3*a*-3*d* show the temporal sequence of the closing process of the furniture hinge 4 which is configured as a so-called zero-protrusion hinge. This means that a furniture part 3 connected to the hinge cup 9*a* can be opened to such an extent that the movable furniture part 3, in its fully open position, does not hinder a pulling-out movement of inner drawers over the entire extraction path when the inner drawers have a maximum width and are displaceably arranged within the furniture carcass 2. The furniture hinge 4 includes a plurality of hinge portions 5, 6, 7, 8, 9, 10 which are hingedly connected to one another by seven hinge axes A, B, C, D, E, F, G (FIG. 2), and a damping device 25, preferably a hydraulic linear damper, for dampening a movement of the hinge 4 is integrated into the hinge portion 8 formed as a hinged lever 8*a*. This can be effected, for example, in such a way that the hinged lever 8*a* has a substantially U-shaped portion in cross section and that the damping device 25 is accommodated within this U-shaped portion. The damping device 25 has a housing 26 in the form of a cylinder in which a piston 27 with a piston rod 28 is arranged. For resetting the damping device 25 into an initial position, a return spring 30 in the form of a compression spring is arranged in the housing 26 and which is supported on the piston 27 on the one hand and on the housing 26 on the other hand. The piston rod 28 is connected via a bearing 31 (FIG. 3*d*) to the hinge portion 8. The spring device 16 by which the furniture hinge 4 can be moved from a predetermined angular position into the fully closed position and/or into the fully open position is entirely arranged within the internal cavity 12 (FIG. 2) of the hinge cup 9*a*. The spring device 16, in the shown embodiment, includes at least one helical spring 16*a*, preferably a compression spring, which surrounds the shaft 18 which is formed as a one-piece construction with the pressure portion 17. The displaceable pressure portion 17 is being pushed against the control curve 21 of the control cam 20 by the force of the helical spring 16*a*. The control cam 20 is motionally coupled to a movement of the hinge 4, pivotally mounted about the hinge axis G and connected via the bolt 22 to the hinge portion 8 in a torque-proof manner.

Figure 3A:
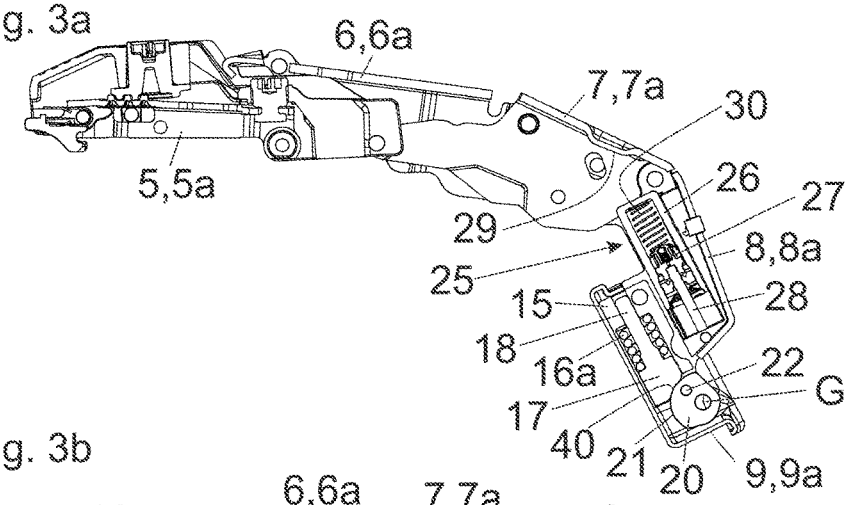
FIGS. 3*a*-3*d* show the closing process of the furniture hinge in temporal sequences.
Figure 3B:
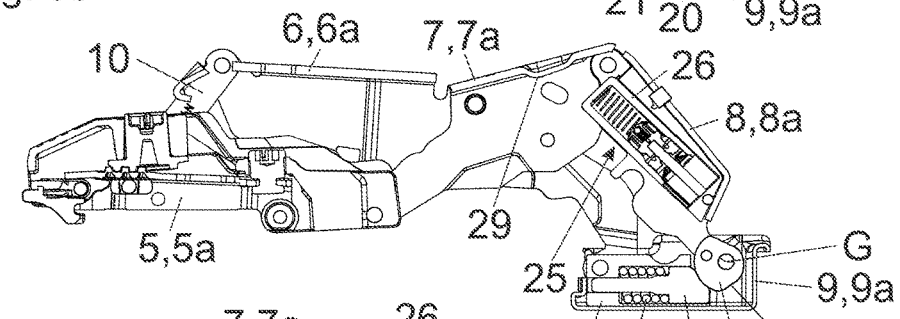

According to FIG. 3*a*, the furniture hinge 4 is located in a fully open position so that the movable furniture part 3 (FIG. 1) connected to the hinge cup 9*a* can also assume a maximum opening position of approximately 170° relative to a front face of the furniture carcass 2. FIG. 3*b* shows a further closed position of the furniture hinge 4. In this arrangement, the damping device 25, together with the control curve 21, are synchronously pivoted about the hinge axis G and by the interaction between the control curve 21 and the counter contour 40 of the pressure portion 17 abutting thereon, no force of the helical spring 16*a* onto the furniture hinge 4 is operative yet. The counter contour 40 of the pressure portion 17 has a concave section at least over a region, the concave section is formed complementary with respect to the convex control curve 21. Thus, the control curve 21 and the counter contour 40 have countercurrent forms in order to flatly abut onto each other in sections. In this way, the occurring forces are distributed over a larger area so that point contacts or line contacts with high pressing forces can be prevented. As a result, the danger of premature wear of these components is reduced. The control curve 21 and the counter contour 40, at least in a middle position of the furniture hinge 4 which corresponds to a half-open position of the movable furniture part 3 in the mounted condition, bear against each other.

Figure 3C:
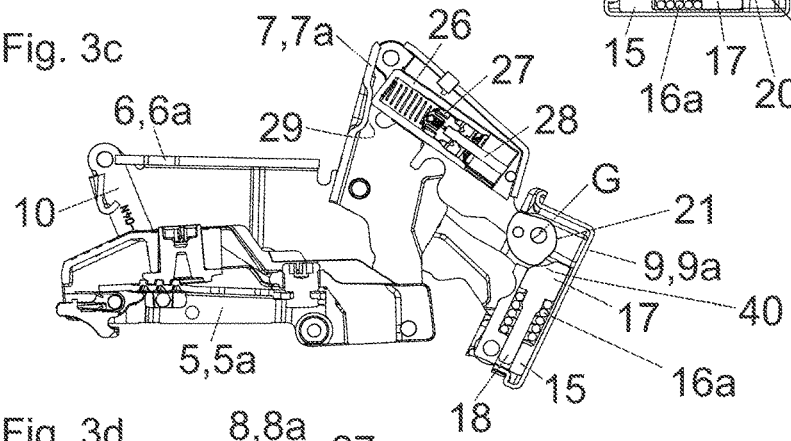
Figure 3D:
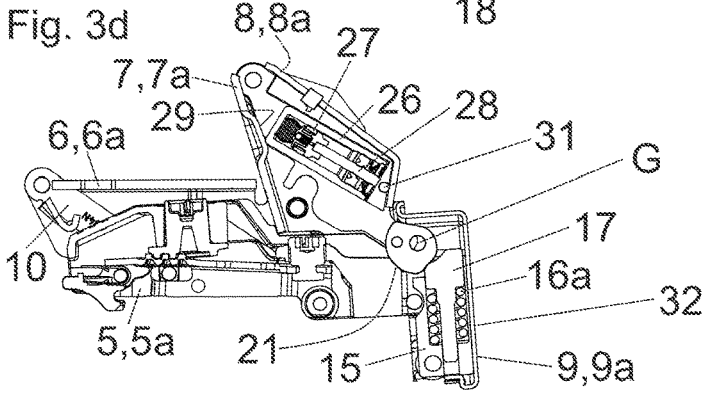

FIG. 3*c*, in contrast, shows a further closed position in which the force of the helical spring 16*a* starts to operate. In the illustrated relative position of the furniture hinge 4, the helical spring 16*a* can relax due to the interaction of the control curve 21 with the corresponding counter contour 40 of the pressure portion 17. As a result, the pressure portion 17 is further displaced in a direction towards the hinge axis G and therewith pushes the furniture hinge 4 into the fully closed position shown as shown in FIG. 3*d*. In order to dampen this movement of the hinge 4, the hinge portion 7 has a protrusion 29 extending inwardly, the protrusion 29 presses the housing 26 of the damping device 25 starting from FIG. 3*c* relative to the axially immovable piston 27, so that the movement of the housing 26 relative to the piston 27 is being braked by the resistance of a damping fluid contained within the housing 26 and therewith the movement of the furniture hinge 4 into the fully closed position is being decelerated. The protrusion 29 of the hinge portion 7, on which the housing 26 of the damping device 25 can be supported, is preferably formed as an embossment made by pressure forming and faces towards the housing 26.

Figure 4A:
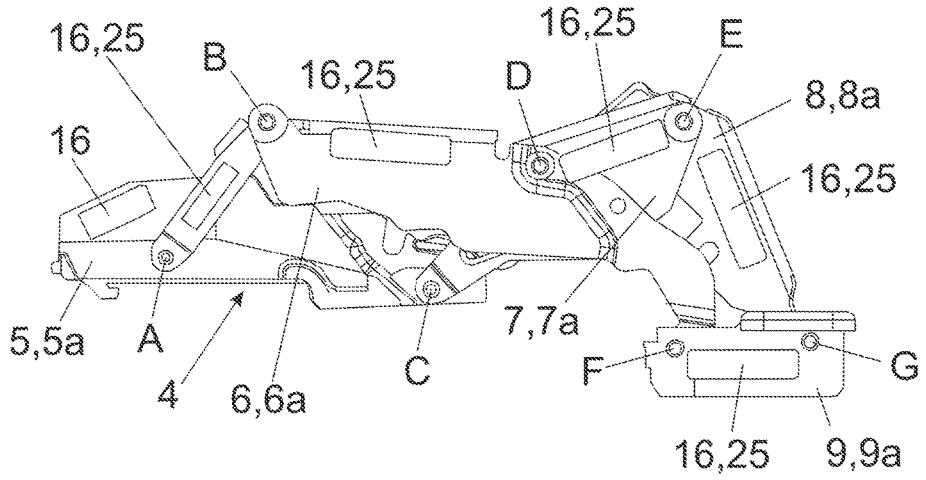
FIGS. 4*a*, 4*b* show possible arrangements of the spring device and the damping device on a furniture hinge according to FIG. 2, and a perspective view of the furniture hinge having a switch for deactivating or for adjustably limiting a damping power of the damping device.

FIG. 4*a* shows possible arrangements of the spring device 16 and of the damping device 25 on a furniture hinge 4 according to FIG. 2. According to a first embodiment, the spring device 16 for moving the furniture hinge 4 into the fully closed and/or fully open position can be arranged, for example, in or on a hinge portion 5 configured as a hinge arm 5*a*, while the damping device 25 for dampening a movement of the hinge 4 is arranged in or on the pivotally supported lever 10, and the control curve 21 is then to be arranged pivotally about the hinge axis A. According to a second embodiment, the spring device 16 can be arranged in or on the lever 10, while the damping device 25 is arranged in or on the hinge portion 6 configured as the intermediate piece 6*a*, and the control curve 21 is to be pivotally arranged about the hinge axis B. Following this scheme, the spring device 16 and the damping device 25 can also be arranged in the first hinge lever 7*a*, in the second hinge lever 8*a* and in the hinge portion 9 formed as the hinge cup 9*a*, and the control curve 21 is then to be pivotally arranged on that hinge axis A, B, C, D, E, F, G which connects that hinge portions 5, 6, 7, 8, 9, 10 to one another on which the spring device 16 and the damping device 25, arranged on a movable hinge portion, are supported.

Instead of a damping device 25 in the form of a linear damper having the housing 26, the piston 27 and the piston rod 28, also rotational dampers can be naturally applied. Rotational dampers usually have a rotor pivotally arranged within a housing which is filled with a viscous fluid. Upon a rotation of the rotor, a respective braking force is generated. By way of a shaft protruding from the housing and a pinion, the engagement with a toothed rack or with a toothed segment is possible. The housing of the rotational damper can thus be arranged on the movably supported hinge portion 8. The pinion arranged on the shaft can be driven by a displaceably mounted toothed rack. A free end of the toothed rack can then by acted upon by the protrusion 29 shown in FIGS. 3*a*-3*d* from the predetermined angular position of the furniture hinge 4 towards the fully closed position, so that the pinion of the rotational damper can be driven.

Figure 4B:
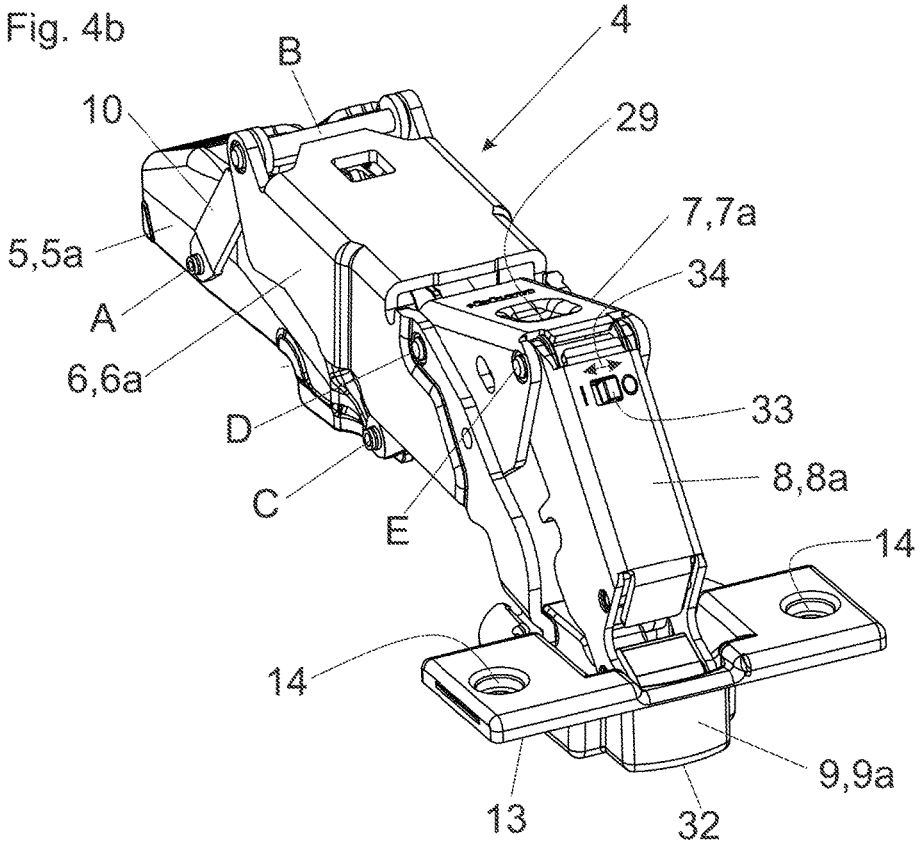

FIG. 4*b* shows the furniture hinge 4 in a perspective view from the front. Arranged on one of the hinge portions 5, 6, 7, 8, 9, 10—preferably on the hinge portion 8 formed as a hinged lever 8*a* connected to the hinge cup 9*a* via the hinge axis G—is a switch 33 configured to be actuated by a person. The switch 33 has a first switching position and at least a second switching position. In the first switching position of the switch 33, the damping power of the damping device 25 is deactivated or limited. In the second position of the switch 33, the damping power of the damping device 25 is activated. It is preferably provided that the switch 33 is arranged on that movable hinge portion 6, 7, 8, 9, 10 on which also the damping device 25 is arranged. In the illustrated embodiment, the damping device 25 is arranged in or on that hinge portion 8 which is directly connected to the hinge cup 9*a* via the hinge axis G. The deactivation or adjustable limitation of the damping power of the damping device 25 is namely in that case advantageous, when the movable furniture part 3 is pivotally connected to the furniture carcass 2 by two or more furniture hinges 4. Assuming that all furniture hinges 4 had a predetermined damping power, the overall damping could result as too high, so that the furniture part 3 remains in an undesired open position and cannot be closed in a duly manner. By way of the switch 33, the damping power of a first furniture hinge 4 can therefore be deactivated or limited for example, while the damping power of a second furniture hinge 4 can be activated. In this way, the overall damping power of two or more furniture hinges 4 can be variably adapted to the size and weight of the movable furniture part 3. In the illustrated embodiment, the switch 33 is movably supported in a direction of the depicted double arrow 34 transverse, preferably substantially at a right angle, to a main longitudinal axis of the hinge portion 8. The switch 33 is accessible from the outside for a manual or for a tool-assisted actuation.

Figure 5A:
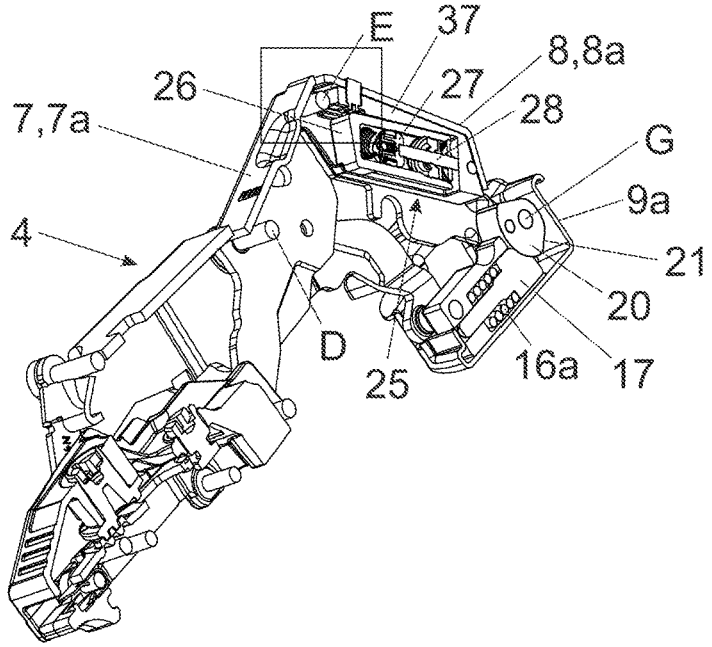
FIGS. 5*a*, 5*b*, 5*c* show the furniture hinge in a cross sectional view and two detail views of the switch in two different switching positions.

FIG. 5*a* shows the furniture hinge 4 in a cross sectional view, in which the damping device 25 is integrated into the hinge lever 8*a* and the spring device 16 is integrated into the hinge cup 9*a*. The pivoting position of the damping device 25 is motionally coupled to a movement of the control curve 21, the pressure portion 17 being acted upon by the spring device 16 bears against the control curve 21. Fixed to the hinge lever 8*a* is a guide element 37 in which the housing 26 of the damping device 25 is displaceably supported.

Figure 5B:
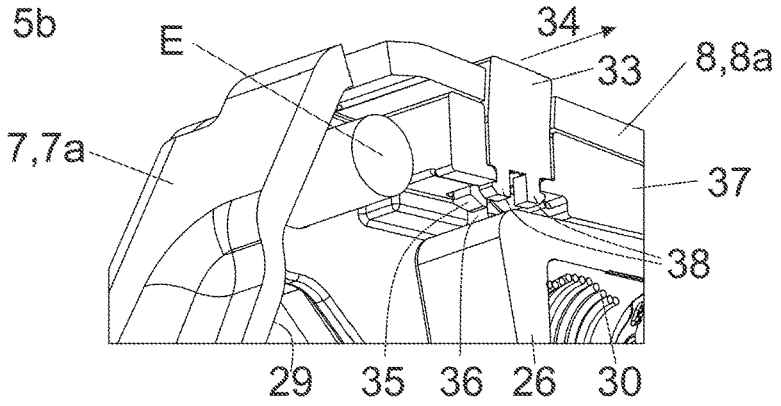
Figure 5C:
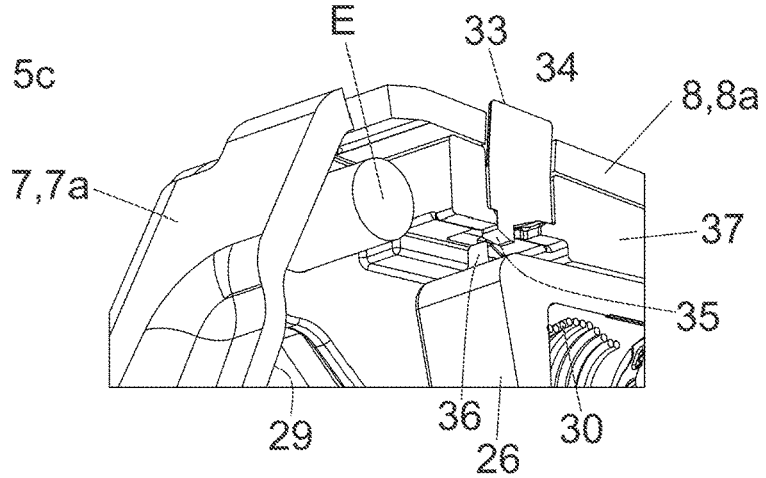

FIG. 5*b* shows the first position of the switch 33 in which the damping power of the damping device 25 is deactivated or limited. For this purpose, the switch 33 has a stop 35 which, in the illustrated figure, interacts with a counterstop 36 arranged on the housing 26 of the damping device 25 so that an extension movement of the housing 26, caused by the return spring 30, in a direction towards the protrusion 29 of the hinged lever 7*a* is inhibited. Upon the closing movement of the furniture hinge 4, the protrusion 29 of the hinged lever 7*a* can thus not contact the housing 26, so that no relative movement between the housing 26 and the piston 27 takes place and therewith no damping power is being generated. However, it is naturally also possible to adjustably restrict the extension movement of the housing 26 relative to the piston 27 by a further switching position of the switch 33, so that the housing 26 can be extended over a partial distance of the maximum stroke. The protrusion 29 can then push the housing 26 over the reduced partial distance, so that a limited damping power can be generated. Starting from the first position of the switch 33 according to FIG. 5*b*, the switch 33 can be moved in a direction of the depicted arrow 34 into the second position shown in FIG. 5*c* in which the damping power of the damping device 25 is activated. By an actuation of the switch 33, the stop 35 of the switch 33 and the counterstop 36 of the housing 26 are namely configured to be displaceable relative to one another. As a result, the stop 35 no longer hinders the extension movement of the housing 26. The housing 26 can thus be fully extended by the force of the return spring 30, so that the protrusion 29, upon a closing movement of the furniture hinge 4, can push the housing 26 over the maximum stroke, whereby a maximum damping power is being generated. In order to captively secure the switch 33 to the furniture hinge 4, snappers 38 are provided.

Figure 6A:
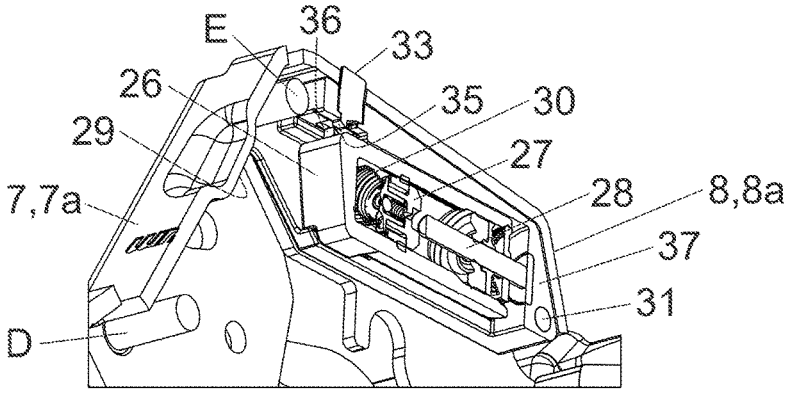
FIGS. 6*a*, 6*b*, 6*c* show a detail view of the furniture hinge in a cross section, a perspective view of the switch and the furniture hinge in a partially exploded view.

FIG. 6*a* shows the damping device 25 integrated into the hinged lever 8*a*. In this arrangement, the piston rod 28 of the linear damper is firmly connected to the guide element 37, i.e. that the piston rod 28 is arranged in the axial direction in an non-displaceable manner. The switch 33 is located in the second switching position so that the stop 38 of the switch 33 and the counterstop 36 of the housing 26 of the damping device 25 do not interact with one another and thus a full extension of the housing 26 by the force of the return spring 20 is made possible. The housing 26 can be pushed over the entire stroke length by the protrusion 29 formed on the hinged lever 7*a* so that the damping power is activated.

Figure 6B:
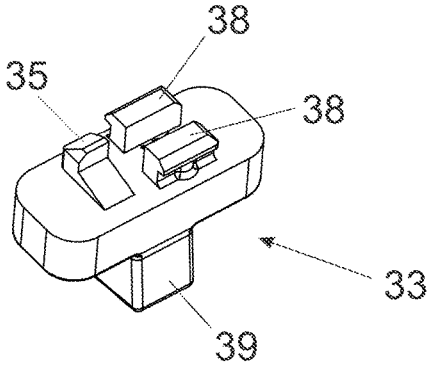

FIG. 6*b* shows a perspective view of the switch 33 from below. For fastening to the furniture hinge 4, resilient snappers 38 are provided, the stop 35 is configured to interact with the counterstop 36 arranged on the housing 26 in the first switching position in which the damping power of the damping device 25 is deactivated or restricted. By way of an actuating portion 39, the switch 33 can either be adjusted manually or with the aid of a tool between the at least two switching positions.

Figure 6C:
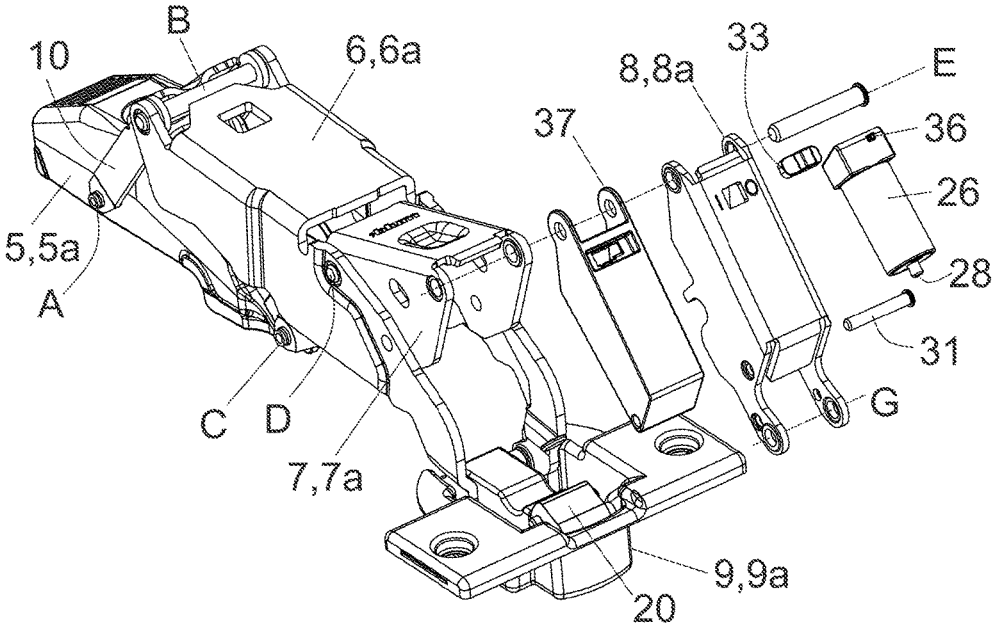

FIG. 6*c* shows the furniture hinge 4 in a partially exploded view. The housing 26 of the damping device 25 having the counterstop 36 is displaceably mounted in the guide element 37, and the guide element 37 is supported on the hinged lever 8*a* via the bearing 31. The end of the piston rod 28 fed out of the housing 26 is supported on the guide element 37. The snappers 38 of the switch 33 engage behind the guide element 37 so that the switch 33 is fixed to the furniture hinge 4 and the actuating portion 39 of the switch 33 is configured to be actuated by a person from the outside.

The invention claimed is:

1. A furniture hinge comprising:

a first hinge portion to be fixed to a furniture carcass;

a second hinge portion having a hinge cup to be fixed to a movably-mounted furniture part;

a hinge axis connecting the first hinge portion and the second hinge portion;

a bearing portion inserted into the hinge cup, the bearing portion including a cavity;

a spring device configured to move the furniture hinge from a predetermined angular position into a fully closed position and/or into a fully open position, wherein a first end region of the spring device is supported on the bearing portion when the bearing portion is inserted into the hinge cup, the cavity being configured to accommodate the spring device;

a convex control curve configured to interact from the predetermined angular position towards the fully closed position and/or fully open position via the spring device; and a pressure portion having a counter contour configured to be pressed against the convex control curve by the spring device, wherein the counter contour has a concave section complementary to the convex control curve.

2. The furniture hinge according to claim 1, wherein the convex control curve and the counter contour, in an intermediate position of the furniture hinge which corresponds to the half-open position of the movably-mounted furniture part in the mounted condition, bear against each other.

3. The furniture hinge according to claim 1, wherein the convex control curve is motionally coupled to a movement of the furniture hinge and is pivotally mounted about the hinge axis of the furniture hinge.

4. The furniture hinge according to claim 1, wherein a plurality of hinge portions including the first hinge portion and the second hinge portion are connected to one another by at least five hinge axes.

5. The furniture hinge according to claim 1, wherein the spring device includes a helical spring.

6. The furniture hinge according to claim 5, wherein the helical spring is arranged within the hinge cup in a lying position and is arranged parallel to a base of the hinge cup.

7. The furniture hinge according to claim 5, wherein the hinge cup, together with the helical spring arranged therein, is arranged entirely within a cylindrical bore of the furniture part.

8. The furniture hinge according to claim 5, wherein the pressure portion is connected to a shaft, wherein the helical spring, at least partially, surrounds the shaft.

9. The furniture hinge according to claim 5, wherein the helical spring is a compression spring.

10. The furniture hinge according to claim 1, further comprising a damping device configured to dampen a movement of the furniture hinge, the damping device being mounted to or placed within a movably-mounted hinge portion connected via a hinge axis to the second hinge portion having a hinge cup so that the movably-mounted hinge portion is between the first and second hinge portions.

11. The furniture hinge according to claim 10, wherein the damping device, upon a movement of the convex control curve, is configured to move together with the convex control curve.

12. The furniture hinge according to claim 10, wherein the damping device includes a linear damper with a housing in which a piston with a piston rod are accommodated, wherein the piston rod, from the predetermined angular position towards the fully closed position and/or fully open position, is supported on a hinge portion and, one end of the housing is supported on a further hinge portion of the furniture hinge.

13. The furniture hinge according to claim 12, wherein the piston rod or the housing of the damping device, from the predetermined angular position towards the fully closed position and/or fully open position, is configured to interact with a protrusion arranged or formed on a hinge portion.

14. The furniture hinge according to claim 13, wherein the protrusion is an embossment.

15. The furniture hinge according to claim 10, wherein the furniture hinge has a switch movably arranged on a hinge portion and configured to be actuated by a person, the switch has a first switching position and a second switching position, wherein in the first switching position of the switch, a damping power of the damping device is deactivated or limited by causing a stop portion of the switch to interact with a counterstop portion of the damping device in order to restrict the movement of the damping device and wherein in the second switching position of the switch, the damping power of the damping device is activated by causing the stop portion of the switch to not restrict the movement of the damping device.

16. The furniture hinge according to claim 15, wherein the switch is arranged on the hinge portion on which the damping device is arranged, wherein the switch is movably mounted in a transverse direction with respect to a main longitudinal axis of the hinge portion.

17. The furniture hinge according to claim 16, wherein the transverse direction is at a right angle with respect to the main longitudinal axis of the hinge portion.

18. The furniture hinge according to claim 1, wherein the bearing portion, in the mounted condition, is entirely arranged within an internal cavity of the hinge cup.

19. A piece of furniture comprising:

a furniture body; and a movable furniture part, wherein said movable furniture part is movably mounted to said furniture body via said furniture hinge according to claim 1.

* * * * *